United States Patent [19]

Iannucci

[11] Patent Number: 5,044,034

[45] Date of Patent: Sep. 3, 1991

[54] SWIMMING POOL VACUUM CLEANER WITH ROTARY BRUSH

[76] Inventor: Anthony A. Iannucci, 140 W. Ross Grove Rd., Shelby, N.C. 28150

[21] Appl. No.: 604,217

[22] Filed: Oct. 29, 1990

[51] Int. Cl.[5] ..... E04H 3/20

[52] U.S. Cl. ..... 15/1.7; 15/387

[58] Field of Search ..... 15/1.7, 387

[56] References Cited

U.S. PATENT DOCUMENTS

| | | | |
|---|---|---|---|
| 987,820 | 3/1911 | Parker | 15/387 X |
| 2,703,904 | 3/1955 | De Lons | 15/387 X |
| 3,008,159 | 11/1961 | Del Vecchio | 15/1.7 |
| 3,909,875 | 10/1975 | Rother et al. | 15/387 |
| 4,589,161 | 5/1986 | Kochte et al. | 15/387 |

*Primary Examiner*—Edward L. Roberts

*Attorney, Agent, or Firm*—Clifton Ted Hunt

[57] ABSTRACT

A swimming pool vacuum cleaner has a water powered turbine and a rotary brush directly and rigidly connected to the turbine so that rotation of the turbine imparts corresponding rotation to the rotary brush. A stationary brush partially surrounds the rotary brush and a foraminated screen is positioned upstream from the brushes to trap residue loosened by the brushes.

5 Claims, 2 Drawing Sheets

SWIMMING POOL VACUUM CLEANER WITH ROTARY BRUSH

FIELD OF THE INVENTION

This invention relates to vacuum cleaners for swimming pools and more specifically to the combination with such a cleaner of a turbine and a rotary brush directly connected to the turbine for rotation therewith.

BACKGROUND OF THE INVENTION

Vacuum cleaners operated by suction for cleaning the surface at the bottom of a swimming pool have long been known. Some of the prior art pool cleaners include stationary brushes and at least one of them includes rotary brushes, but which are only gently engageable with the surface at the bottom of the pool for dislodging particulate material from the pool floor and for contributing to localized turbulence.

See for example, the following prior art:

| U.S. Pat. No. | ISSUE DATE | INVENTOR | TITLE |
|---|---|---|---|
| 4,094,031 | June 13, 1978 | Cellini | CLEANING APPARATUS FOR SELECTED SMALL AREAS OF A SWIMMING POOL |
| 4,193,228 | Mar 18, 1980 | Bowler | WATER DRIVEN TOOL |
| 4,463,525 | Aug 7, 1984 | Sheber | HAND-HELD CLEANING TOOL WITH REMOTE WATER TURBINE POWER SOURCE |
| 4,692,956 | Sept 15, 1987 | Kassis | POOL VACUUM |
| 4,734,954 | Apr 5, 1988 | Greskovics | POOL SCRUBBER DEVICE |
| 4,786,334 | Nov 22, 1988 | Nystrom | METHOD OF CLEANING THE BOTTOM OF A POOL |

The bristles at the bottom of the hand operated vacuum apparatus of Cellini are stationary.

Bowler and Greskovics each show a rotary cleaning tool for swimming pools that is operated by external water pressure.

Sheber discloses a rotary cleaning tool powered by a remote turbine, through which water is drawn by suction, for cleaning calcium from decorative tile above the surface of the water around the sides of the pool.

Kassis shows fixed stiff bristles arranged around a plurality of fine bristles. The fixed stiff bristles normally rest on the pool bottom. The fine bristles are normally spaced above the surface of the pool bottom and rotate to create turbulence with helically twisted blades which rotate as water is drawn past them by suction. The fine bristles readily flex when even light contact is made with the surface of the pool, rather than produce increased friction for effective cleaning of the pool bottom.

Nystrom shows a self propelled pool cleaner with rotary brushes rotated on a horizontal axis by an electric motor.

SUMMARY OF THE INVENTION

The swimming pool vacuum cleaner of this invention combines in one unit a turbine, a stiff brush rotatable on a vertical axis through a direct and rigid connection with the turbine. A fixed stiff brush partially surrounds the rotary brush and localizes residue cleaned from the pool bottom to be trapped by a screen upstream from the brushes.

The turbine is powered by water drawn through it by an external source of suction and transmits sufficient power to the stiff rotary brush for effective cleaning of the pool bottom. The fixed brush helps clean the surface of the pool bottom and also retains the residue brushed from the pool bottom within the housing to be trapped on the screen.

BRIEF DESCRIPTION OF THE DRAWINGS

FIG. 3 is an exploded perspective view, partially in section, illustrating the assembly of the pool cleaner.

DETAILED DESCRIPTION OF THE INVENTION

Figure 1:
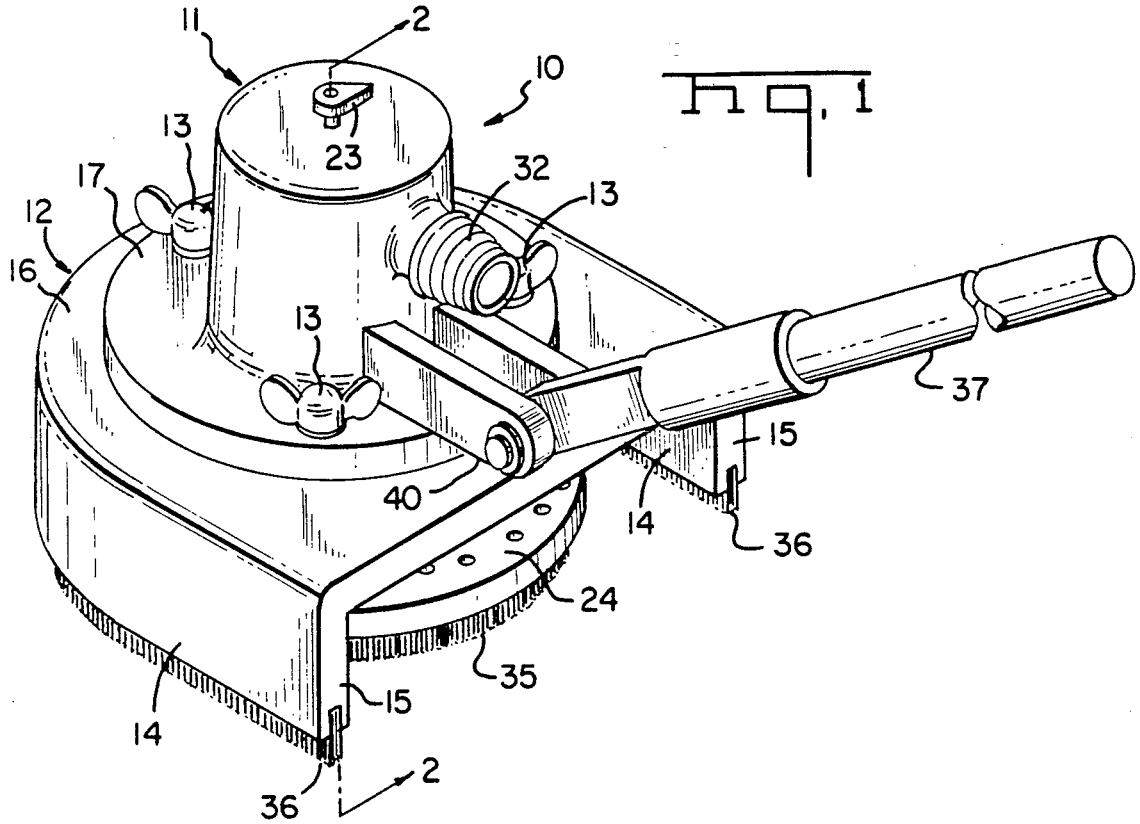
FIG. 1 is a perspective view looking at the top, one side, and rear of the swimming pool vacuum cleaner.

Referring more specifically to the drawings, the numeral 10 broadly indicates a swimming pool vacuum cleaner comprising an upper or turbine housing 11 and a lower or brush housing 12. Bolts 13 connect the two housings. The lower housing 12 is of generally U-shaped configuration with side walls 14 terminating at the rear 15 of the housing and defining an opening extending across the rear of the housing. The housing 12 also includes a top wall 16. A peripheral flange 17 extends about the base of the upper housing 11 and the bolts 13 extend through the flange 17 and into the top 16 of the lower housing 12.

A rotatable shaft 20 extends loosely through the two housings and is journaled in a thrust bearing 21 beneath the top 16 of the lower housing 12. A mounting plate 22 is fixed to or formed integral with the lower end of the shaft 20 in FIG. 2 and a visual efficiency indicator 23 extends from the upper end of the shaft and beyond the upper turbine housing 11.

A circular brush holder 24 is fastened, as by screws 25, to the mounting plate 22. The brush holder has a plurality of openings 26 therethrough for the passage of water, as shown by directional arrows in FIG. 2. A foraminated screen 27 loosely surrounds the shaft 20 between the brush holder 24 and the top wall 16 of the brush housing 12. The screen 27 is removably mounted between flanges 30 on the inner surface of the side walls 14.

Openings 31 in the top wall 16 provide communication between the lower brush housing 12 and the upper turbine housing 11. Water is drawn into the brush housing 12 and through the turbine housing 11 by an external source of suction, not shown, connected to the turbine housing 11 by a hose adaptor 32.

A turbine 33 is fixed to the shaft 20 within the turbine housing 11. The turbine's vanes 34 project into the restricted path of water through the turbine housing and the passage of water causes the turbine and the integrated shaft 20 to rotate in a known manner.

A circular brush 35 is removably fixed for rotation with the brush holder 24 so that rotation of the shaft 20 by the turbine 33 causes corresponding rotation of the brush holder 24 and its brush 35. The rotatable brush 35 has stiff bristles for cleaning residue from the surface of the pool bottom.

A fixed stiff brush 36 depends from the side wall 16 of the brush housing 12 in outwardly spaced relation to the rotatable brush 35.

Figure 2:
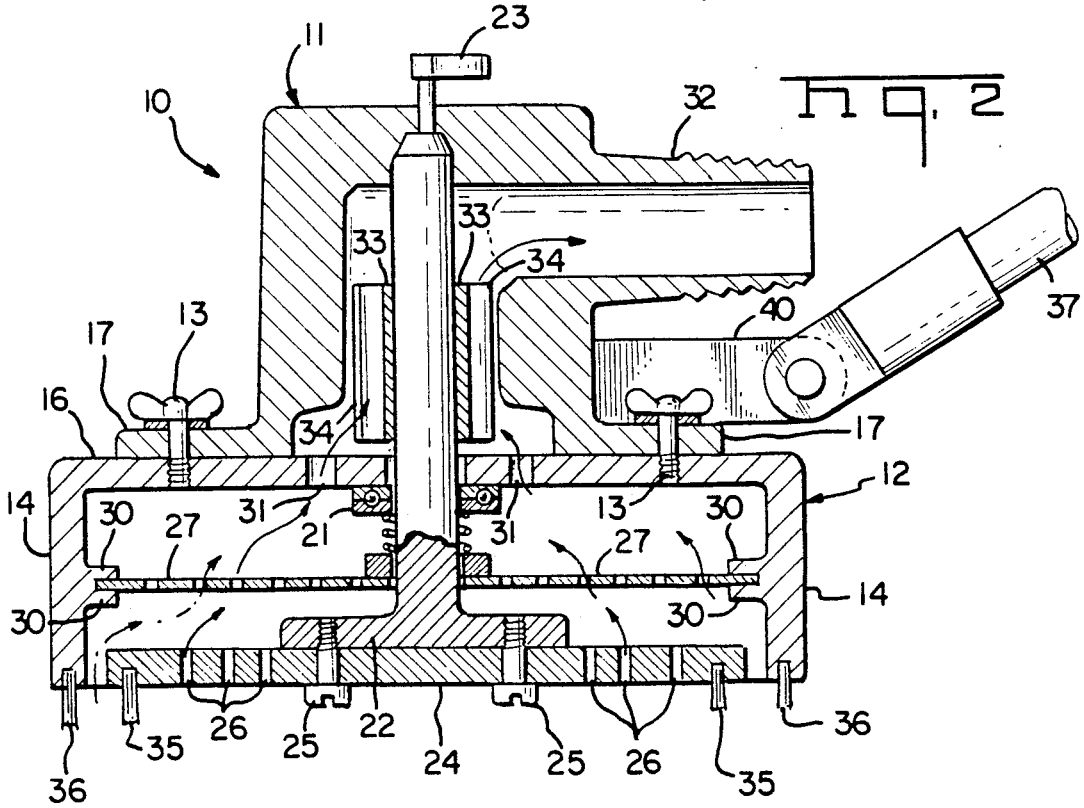
FIG. 2 is a sectional view, partially in elevation, taken substantially along the line 2—2 in FIG. 1.
Figure 7:
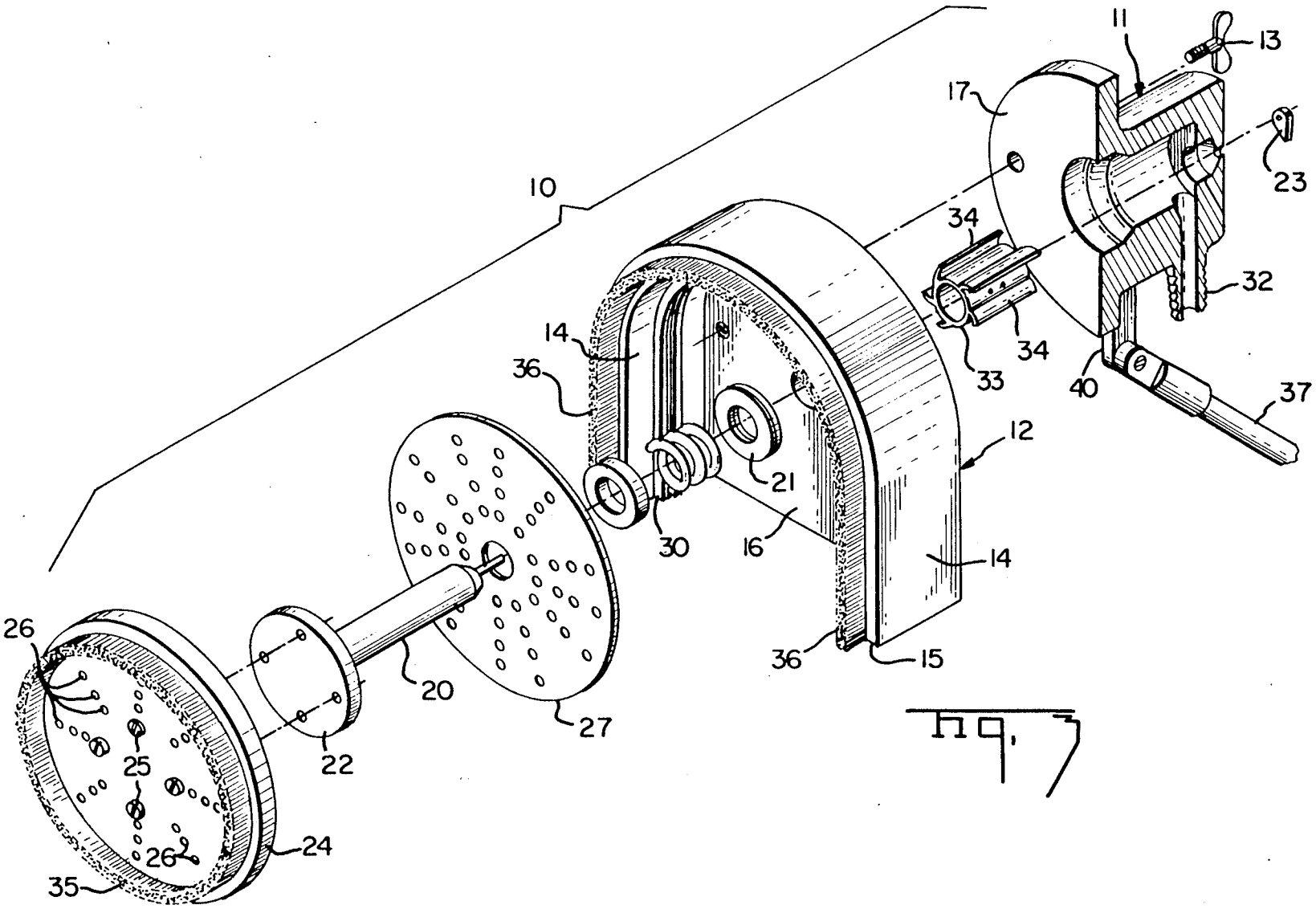

The free ends of the brushes 35 and 36 terminate in substanially the same plane, as best seen in FIG. 2, and cooperate in removing residue from the surface of the pool bottom as the pool cleaner 10 is moved across the pool bottom by a handle 37 pivotally mounted to a clevis 40 extending from the turbine housing 11.

In use, water flows through the housings 12, 11 and turbine 33, as shown by the directional arrows in FIG. 2, causing rotation of the turbine and corresponding rotation of the shaft 20 and brush 35 through their direct and rigid interconnection. The direct and rigid connection of the rotary brush 35 to the turbine enables the brush 35 to be rotated with sufficient power to effectively clean residue from the pool. The visual efficiency indicator enables the user to continually monitor the operation of the cleaner. The flow of water from the brushes 35 and 36 through the screen 27 efficiently deposits the residue removed by the brushes on the screen 27. The screen 27 may be removed, cleaned, and replaced through the opening in the rear 15 of the brush housing 12.

There is thus provided an improved swimming pool vacuum cleaner with a positively driven water powered rotary brush operating under sufficient power to effectively clean residue from the surface of the pool bottom. The impingement of the removed residue on the removable screen enables efficient disposition of the residue.

Although specific terms have been used in describing the invention, they have been used in a generic and descriptive sense only and not for the purpose of limitation.

I claim:

1. In a swimming pool vacuum cleaner having a turbine housing, a turbine within the turbine housing, a brush housing communicatively connected to the turbine housing, a passageway for water through the turbine and brush housings, an adaptor communicating with the turbine housing for connection to a source of suction, a circular brush holder within the brush housing and a rotatable shaft fixed to the turbine for rotation therewith and fixed to the brush holder to impart corresponding rotation to the brush holder about a substantially vertical axis in use, the improvement which comprises:

(a) a rotary brush of circular configuration fixed about the periphery of the brush holder in radially spaced relation to the axis of the brush holder for rotation with the brush holder, (b) said brush housing being of generally U-shaped configuration, (c) side walls on the brush housing extending about the leading edge of the brush holder and terminating at the rear of the brush housing to define an opening extending across the rear of the brush housing, and (d) a stationary brush depending from and conforming with the configuration of the generally U-shaped brush housing.

2. A swimming pool vacuum cleaner according to claim 1 wherein the free ends of the rotary brush and the free ends of the stationary brush terminate in substantially the same plane.

3. A swimming pool vacuum cleaner according to claim 1 wherein the leading edge of the stationary brush is concentric with the circular rotary brush.

4. A swimming pool vacuum cleaner according to claim 1 wherein the circular brush holder is spring loaded for reciprocable movement within the brush housing during use.

5. A swimming pool vacuum cleaner according to claim 1 wherein said rotatable shaft extends outwardly beyond the turbine housing, and a visual efficiency indicator is fixed to the rotatable shaft for rotation therewith at a point beyond the turbine housing.

* * * * *